US011730326B2

(12) United States Patent
Bosses

(10) Patent No.: US 11,730,326 B2
(45) Date of Patent: Aug. 22, 2023

(54) MOUNTING TAB FOR THREADED FITTING OF VACUUM BAG

(71) Applicant: Zenith Technologies, LLC, Fort Lauderdale, FL (US)

(72) Inventor: Mark D Bosses, Boca Raton, FL (US)

(73) Assignee: ZENITH TECHNOLOGIES, LLC, Fort Lauderdale, FL (US)

( * ) Notice: Subject to any disclaimer, the term of this patent is extended or adjusted under 35 U.S.C. 154(b) by 69 days.

(21) Appl. No.: 17/544,913

(22) Filed: Dec. 7, 2021

(65) Prior Publication Data

US 2022/0175207 A1 Jun. 9, 2022

Related U.S. Application Data

(60) Provisional application No. 63/123,354, filed on Dec. 9, 2020.

(51) Int. Cl.

| | |
|---|---|
| ***A47L 9/14*** | (2006.01) |
| ***A47L 9/12*** | (2006.01) |
| ***A47L 5/28*** | (2006.01) |

(52) U.S. Cl.

CPC ..... *A47L 9/1436* (2013.01); *A47L 5/28* (2013.01); *A47L 9/122* (2013.01); *A47L 9/1418* (2013.01); *A47L 9/1472* (2013.01)

(58) Field of Classification Search

CPC ..... A47L 9/1427; A47L 9/1436; A47L 9/1472
See application file for complete search history.

(56) References Cited

U.S. PATENT DOCUMENTS

| | | | | |
|---|---|---|---|---|
| 1,997,720 | A | 4/1935 | Emmons | |
| 2,090,453 | A | 8/1937 | Eathers | |
| RE28,201 | E | 10/1974 | Hughes | |
| 4,364,757 | A | 12/1982 | Eonatti | |
| 4,791,699 | A | 12/1988 | Sovis et al. | |
| 5,057,131 | A | 10/1991 | Lackner et al. | |
| 5,464,460 | A | 11/1995 | Bosses | |
| 5,544,385 | A | 8/1996 | Jailor et al. | |
| 6,007,594 | A | 12/1999 | Kaczor | |
| 6,033,451 | A | 3/2000 | Fish et al. | |
| 6,049,941 | A | 4/2000 | Vollenweider, II | |
| 6,813,808 | B2 | 11/2004 | Nguyen et al. | |
| 6,988,293 | B2 | 1/2006 | Ritter | |
| 7,418,763 | B2 | 9/2008 | Shaver et al. | |
| 8,075,649 | B2 | 12/2011 | Bosses | |
| 9,232,880 | B2 * | 1/2016 | Bosses | A47L 9/1436 |
| 2001/0005983 | A1 | 7/2001 | Berfield et al. | |

(Continued)

FOREIGN PATENT DOCUMENTS

| | | | |
|---|---|---|---|
| DE | 20119853 | U1 | 3/2002 |
| DE | 102008021789 | A1 | 11/2009 |
| DE | 202010016864 | U1 | 3/2011 |

*Primary Examiner* — Bryan R Muller

(74) *Attorney, Agent, or Firm* — Global IP Counselors, LLP

(57) ABSTRACT

A dust collecting assembly for a vacuum cleaner includes a dust collecting member and a threaded fitting. The dust collecting member is configured to collect dust and debris. The threaded fitting is disposed in communication with the dust collecting member. The threaded fitting includes a threaded collar configured to be connected to a vacuum cleaner. At least one mounting tab is spaced from the threaded collar. The mounting tab is configured to be received by the vacuum cleaner.

21 Claims, 10 Drawing Sheets

(56) References Cited

U.S. PATENT DOCUMENTS

| | | | |
|---|---|---|---|
| 2005/0098039 | A1 | 5/2005 | Davis et al. |
| 2007/0095031 | A1 | 5/2007 | Zehuranec |
| 2008/0086991 | A1 | 4/2008 | Hale |
| 2009/0256100 | A1 | 10/2009 | Lee |
| 2010/0050372 | A1 | 3/2010 | Frackowiak |

* cited by examiner

MOUNTING TAB FOR THREADED FITTING OF VACUUM BAG

CROSS REFERENCE TO RELATED APPLICATIONS

This application claims the benefit under 35 U.S.C. § 119(e) of U.S. Provisional Application No. 63/123,354, filed Dec. 9, 2020. The entire disclosure of U.S. Provisional Application No. 63/123,354 is hereby incorporated herein by reference.

BACKGROUND

Field of the Invention

This invention generally relates to a threaded fitting of a vacuum bag. More specifically, the present invention relates to a mounting tab for a threaded fitting of a vacuum bag to facilitate connecting the vacuum bag to a vacuum cleaner.

Background Information

A vacuum bag used with a vacuum cleaner is typically disposable. The vacuum bag is sufficiently durable to permit installation and removal without damage. The vacuum bag has a threaded collar to threadedly engage a threaded member of the vacuum cleaner to attach the vacuum bag to the vacuum cleaner. Cross-threading the threaded connection between the vacuum bag and the housing of the vacuum cleaner when attaching the vacuum bag to the vacuum cleaner can make installation and removal of the vacuum bag difficult.

SUMMARY

Generally, the present disclosure is directed to a vacuum bag having a mounting tab to facilitate connecting the vacuum bag to a vacuum cleaner.

In view of the state of the known technology and in accordance with a first aspect of the present disclosure, a dust collecting assembly for a vacuum cleaner includes a dust collecting member and a threaded fitting. The dust collecting member is configured to collect dust and debris. The threaded fitting is disposed in communication with the dust collecting member. The threaded fitting includes a threaded collar configured to be connected to a vacuum cleaner. At least one mounting tab is spaced from the threaded collar. The mounting tab is configured to be received by the vacuum cleaner.

In view of the state of the known technology and in accordance with a second aspect of the present disclosure, a vacuum cleaner includes a vacuum cleaner body, an attachment assembly connected to the vacuum cleaner body, and a porous container configured to be connected to the attachment assembly. The attachment assembly includes a mounting plate connected to the vacuum cleaner body and a locking handle movably connected to the mounting plate. The locking handle is movable from a first position to a second position. The porous container includes an opening disposed in the porous container and a threaded fitting disposed in communication with the opening. The threaded fitting includes a threaded collar configured to be connected to the attachment assembly, and at least one mounting tab spaced from the threaded collar. The mounting tab is configured to be received by the vacuum cleaner. The locking handle is prevented from moving from the first position to the second position until the at least one mounting tab is received by the attachment assembly.

Also, other objects, features, aspects and advantages of the disclosed mounting tab for a threaded fitting of a vacuum bag will become apparent to those skilled in the art from the following detailed description, which, taken in conjunction with the annexed drawings, discloses several embodiments of a mounting tab for a threaded fitting of a vacuum bag.

BRIEF DESCRIPTION OF THE DRAWINGS

Referring now to the attached drawings which form a part of this original disclosure.

Throughout the drawing figures, like reference numerals will be understood to refer to like parts, components and structures.

DETAILED DESCRIPTION OF EXEMPLARY EMBODIMENTS

Selected exemplary embodiments will now be explained with reference to the drawings. It will be apparent to those skilled in the art from this disclosure that the following descriptions of the exemplary embodiments are provided for illustration only and not for the purpose of limiting the invention as defined by the appended claims and their equivalents.

In accordance with exemplary embodiments of the present disclosure, a mounting tab 10 for a threaded fitting 12 of a vacuum bag 14 for a vacuum cleaner 15 is shown in FIGS. 1-6. The threaded fitting 12 facilitates connecting the vacuum bag 14 to the vacuum cleaner 15, as shown in FIGS. 6-13. The threaded connection provides an air-tight seal between the vacuum cleaner 15 and the vacuum bag 14. Although the mounting tab 10 for a threaded fitting 12 is described in which a dust collecting member of a dust collecting assembly is a vacuum bag 14, the mounting tab for a threaded fitting is suitable for use with any dust collecting assembly, such as a filter assembly (FIGS. 15 and 16), configured to be attached to a vacuum cleaner. The dust collecting member is configured to collect dust and debris, which includes any matter configured to be drawn in or expelled by operation of the vacuum cleaner 15.

Figure 1:
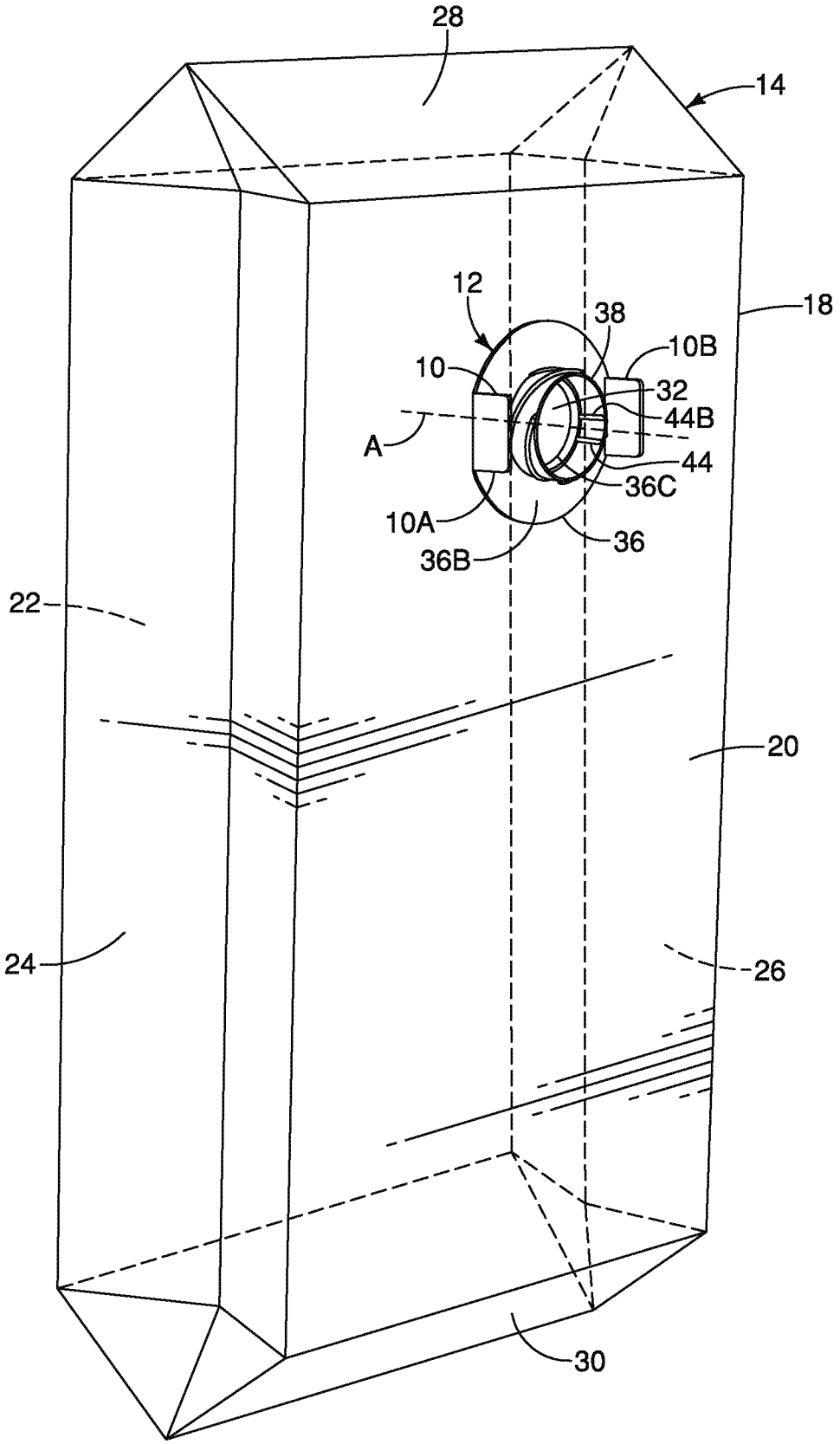
FIG. 1 is a perspective view of a threaded collar of a vacuum bag having a mounting tab in accordance with an exemplary embodiment of the present invention.
Figure 6:
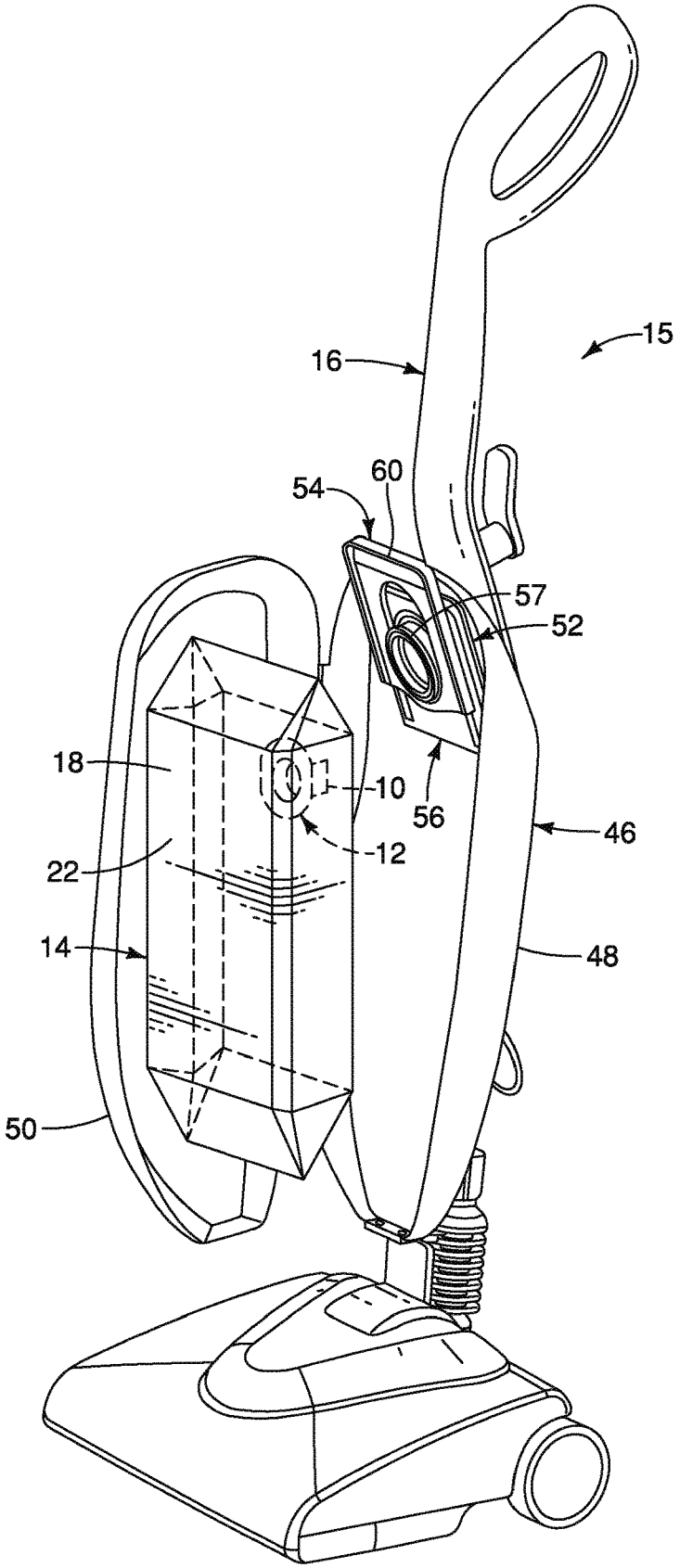
FIG. 6 is a perspective view of the vacuum bag of FIG. 1 prior to being connected to a vacuum cleaner.
Figure 13:
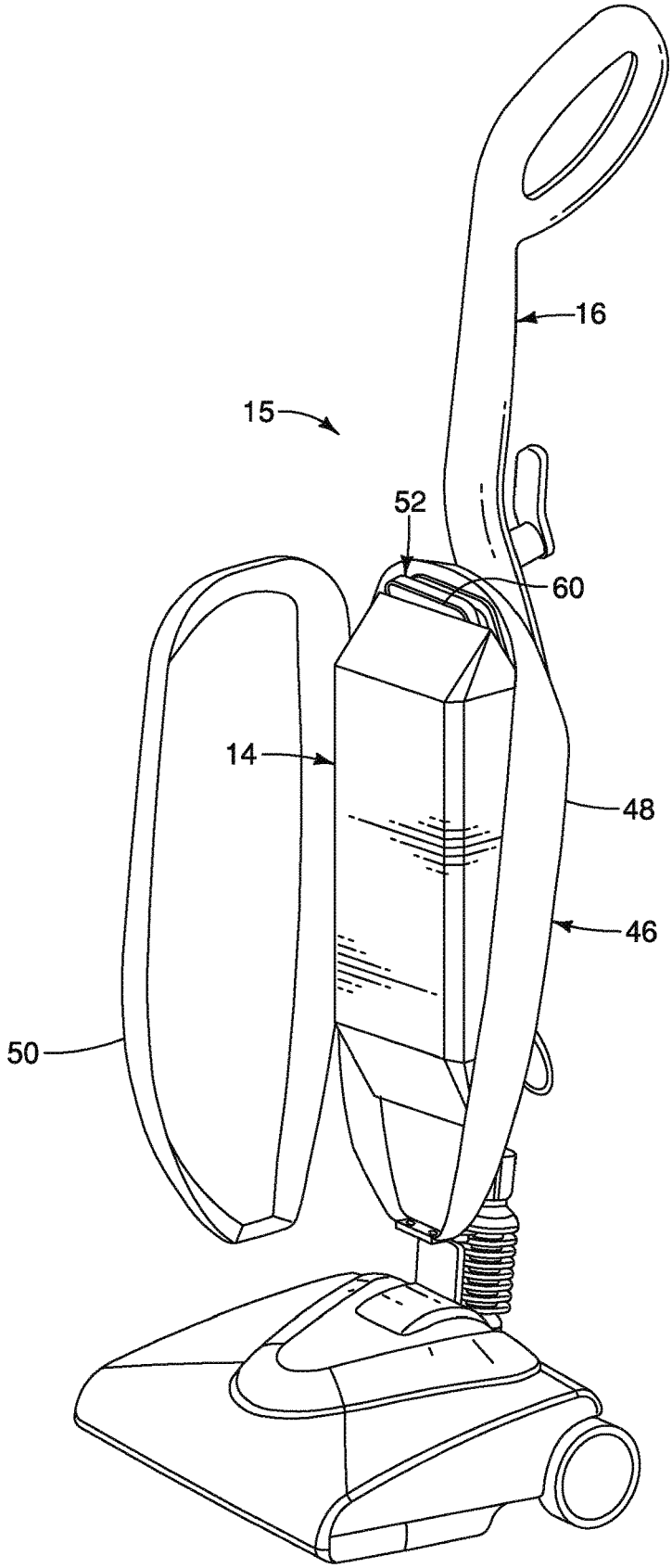
FIG. 13 is a perspective view of the vacuum cleaner of FIG. 7 in which the vacuum bag is attached thereto.

The vacuum bag 14 includes a container portion 18 having a front wall 20, a rear wall 22, first and second side walls 24 and 26, an upper wall 28, and a lower wall 30. Although the container portion 18 is shown with a generally rectangular shape in FIGS. 1 and 6, the container portion 18 can have any suitable shape. The container portion 18 is preferably made of a flexible and porous material, such as, for example, paper, non-woven material, woven material, or a combination thereof. An opening 32 is formed in the front wall 20 of the container portion 18 for intake of dust and debris drawn in through a vacuum nozzle 34 of the vacuum cleaner 15 (FIG. 6). The opening 32 is preferably substantially centered in the front wall 20 in a width direction of the front wall 20, as shown in FIG. 1, although the opening 32 can be disposed in any suitable location of the vacuum bag 14. The opening 32 is preferably disposed in the front wall 20 nearer to the top wall 28 than to the lower wall 30. In other words, the opening 32 is preferably centered horizontally on the front wall 20 proximate the upper wall 28 of the container portion 18 to facilitate disposal in a vacuum cleaner housing, as shown in FIGS. 6 and 13.

A threaded fitting 12 is attached to the front wall 20 of the container portion 18 of the vacuum bag 14, as shown in FIG. 1, in communication with the opening 32. The threaded fitting 12 can be attached to the front wall 20 in any suitable manner, such as, but not limited to, by an adhesive or thermal welding. The threaded fitting 12 includes a flange portion 36 that is directly connected to the container portion 18. The flange portion 36 has an inner surface 36A and an outer surface 36B. The inner surface 36A is configured to be attached to the front wall 20 of the container portion. An opening 36C in the flange portion 36 is aligned with and in communication with the opening 32 in the front wall 20 of the container portion 18 of the vacuum bag 14.

A threaded collar 38 extends outwardly from the outer surface 36B of the flange portion 36 of the threaded fitting 12, as shown in FIGS. 1-5. The threaded collar 38 is substantially cylindrical in shape. The threaded collar 38 has an inner surface 38A and an outer surface 38B. Threads 40 are disposed on the outer surface 38B of the threaded collar 38 to facilitate connecting the vacuum bag 14 to the vacuum cleaner body 16 of the vacuum cleaner 15 (FIG. 6). The inner surface 38A of the threaded collar 38 defines a passage 42 extending from an end 38C of the threaded collar 38 to the opening 36C in the flange portion 36, such that the passage 42 is aligned with and in communication with the opening 36C in the flange portion 36 and with the opening 32 in the front wall 20 of the vacuum bag 14.

Figure 2:
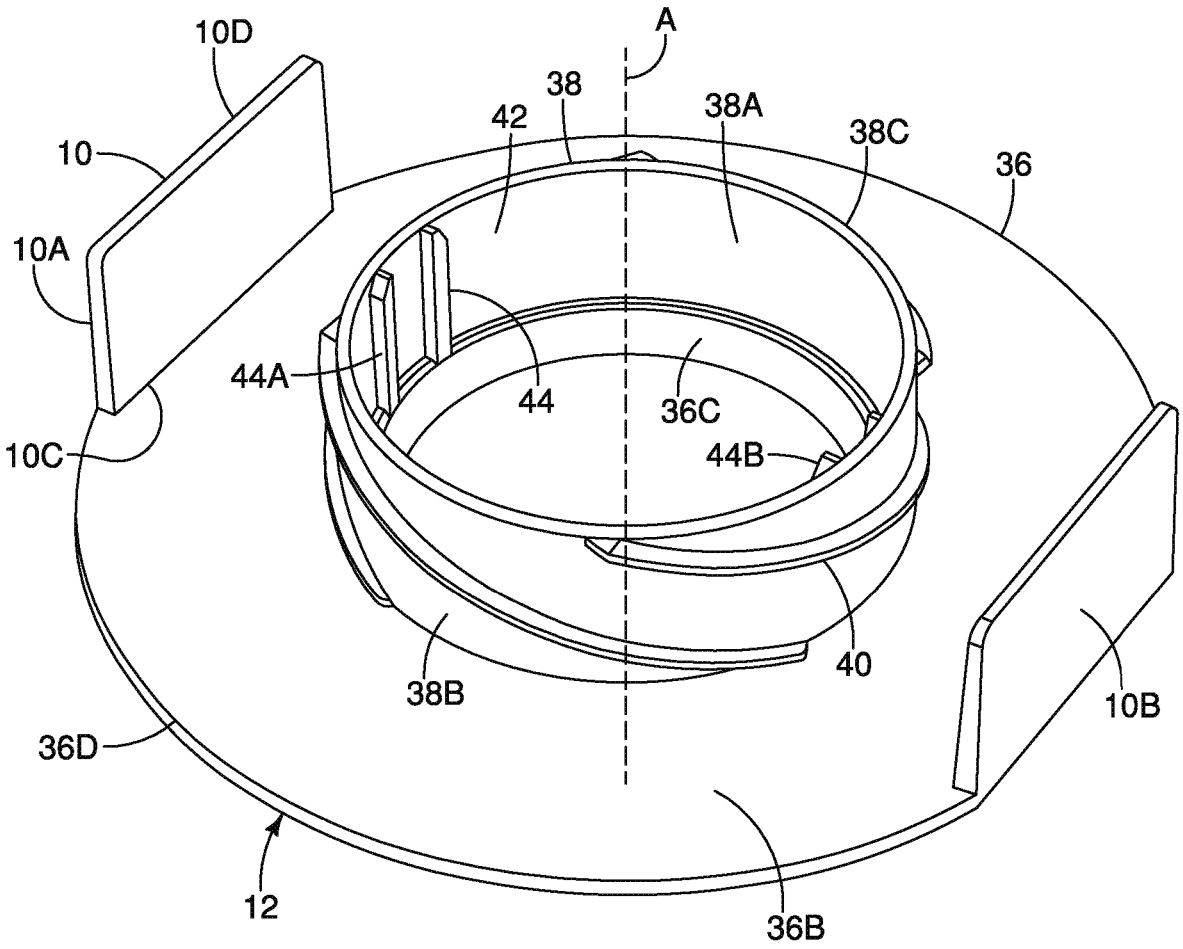
FIG. 2 is a perspective view of the threaded fitting of FIG. 1.
Figure 5:
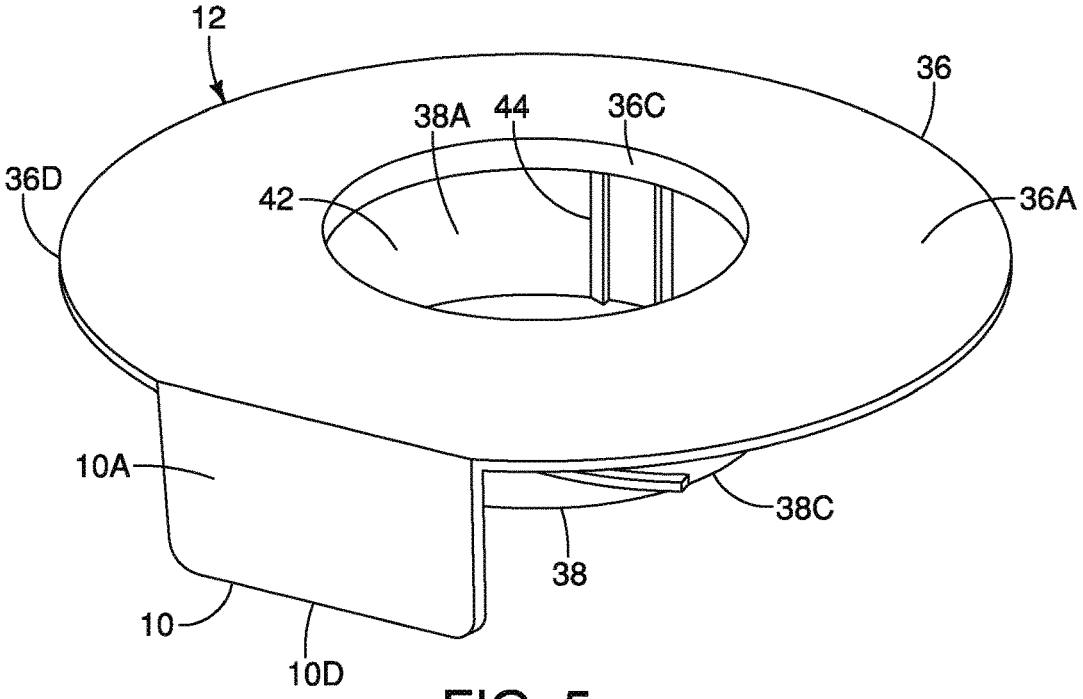
FIG. 5 is a rear perspective view of the threaded fitting of FIG. 2.

A plurality of guide rails 44 can be disposed on the inner surface 38A of the threaded collar 38. The guide rails 44 extend in an axial direction of the threaded collar 38, as shown in FIGS. 2 and 5. Preferably, two pairs of, or first and second, guide rails 44A and 44B are oppositely disposed on the inner surface 38A of the threaded collar 38. Each pair of guide rails 44A and 44B preferably includes two rails, as shown in FIG. 2. The first and second guide rails 44A and 44B are disposed on opposite sides of the inner surface 38A of the threaded collar 38. The guide rails 44 substantially prevent rotation of the vacuum bag 14 when being connected to and disconnected from the vacuum cleaner body 16 of the vacuum cleaner 15. As shown in FIG. 2, the first and second guide rails 44 are disposed between the first and second mounting tabs 10A and 10B in a direction perpendicular to the axial direction A.

Figure 3:
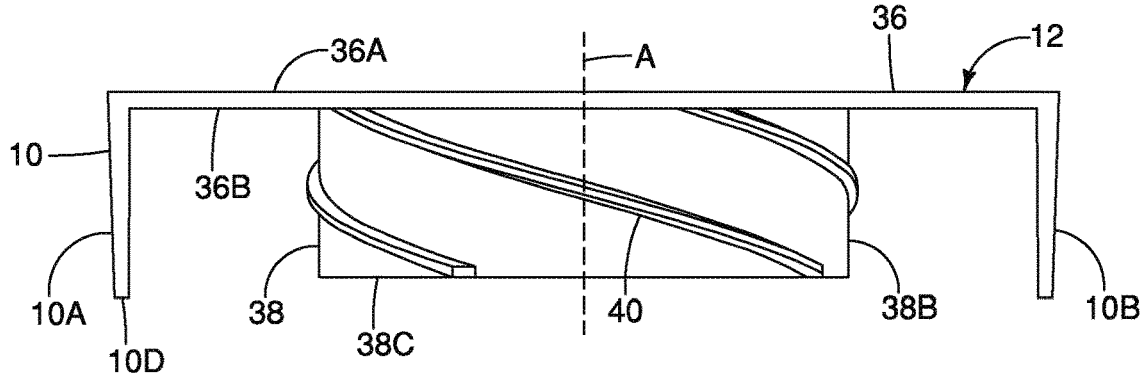
FIG. 3 is a side elevational view of the threaded fitting of FIG. 2.

At least one mounting tab 10 extends outwardly from the threaded fitting 12, as shown in FIGS. 1-5. The at least one mounting tab 10 extends from an outer surface 36B of the flange portion 36. The at least one mounting tab 10 is disposed at an outer perimeter 36D of the outer surface 36B of the flange portion 36. Preferably, the threaded fitting 12 includes a first mounting tab 10A and a second mounting tab 10B. As shown in FIGS. 1-3, the first and second mounting tabs 10A and 10B are preferably disposed on opposite sides of the threaded collar 38. The first and second mounting tabs 10A and 10B are preferably substantially similar.

Figure 4:
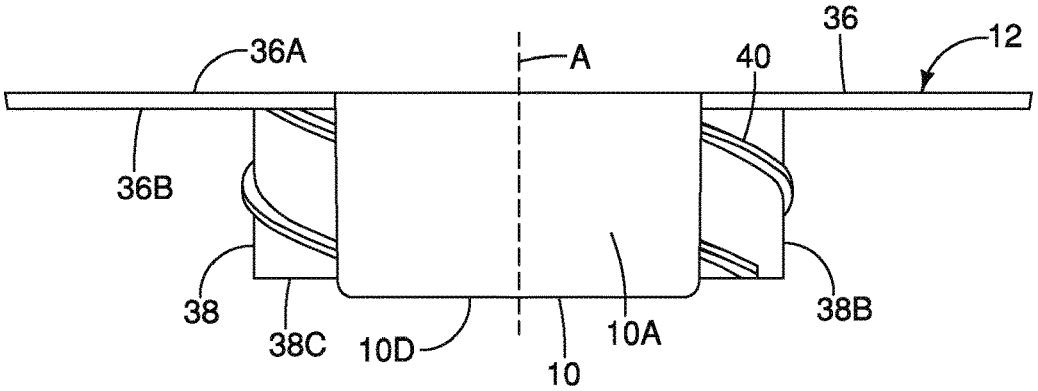
FIG. 4 is a side elevational view of the threaded fitting of FIG. 3 rotated ninety degrees.

The mounting tab 10 has a first end 10C connected to the outer surface 36B of the flange portion 36. A second end 10D of the mounting tab 10 extends axially beyond the end 38C of the threaded collar 38, as shown in FIGS. 3 and 4, in an axial direction A of the opening 32. As shown in FIG. 4, a length of the threaded collar 38 is longer than a length of the mounting tab 10 in a direction perpendicular to the axial direction A of the opening 32. The mounting tab 10 is shown as being substantially rectangular in FIGS. 1-5, although the mounting tab 10 can have any suitable configuration. As shown in FIGS. 1 and 6, the threaded fitting 12 is connected to the vacuum bag 14 such that the mounting tabs 10A and 10B are oriented vertically. In other words, the mounting tabs 10A and 10B have a length that extends in a vertical direction.

The threaded fitting 12 is preferably made of a substantially rigid material, such as, but not limited to, plastic, metal, cardboard, fiberboard or a combination thereof. The threaded fitting 12 is preferably integrally formed as a one-piece member.

The vacuum cleaner body 16 includes a housing 46 that receives the vacuum bag 14, as shown in FIGS. 6 and 13. The housing 46 is preferably porous to allow air passing through the vacuum bag 14 to pass through the housing 46. The housing 46 has a first housing part 48 and a second housing part 50. The first housing part 48 is secured to the vacuum cleaner body 16 of the vacuum cleaner 15, as shown in FIG. 6. A vacuum nozzle has an opening disposed within the housing 46 to which the threaded fitting 12 of the vacuum bag 14 is connected such that the vacuum bag 14 is in fluid communication with the nozzle of the vacuum cleaner body 16 of the vacuum cleaner 15. The second housing part 50 is movably connected to the first housing part 48, such as with a hinge. The remaining portion of the second housing part 50 is connected to the first housing part 48 in any suitable manner, such as with a zipper, to enclose the vacuum bag 14 within the closed housing 46. The second housing part 50 is openable with respect to the first housing part 48, to facilitate installing and removing the vacuum bag 14.

An attachment assembly 52 for the vacuum cleaner 15 includes a locking handle 54 and a mounting plate 56. The mounting plate 56 is fixedly secured to the vacuum cleaner body 16. The locking handle 54 is movably fixed to the mounting plate 56, as shown in FIGS. 6, 8, 10, 11 and 13. The locking handle 54 is movably connected to the mounting plate 56 to be movable from a first position (FIG. 6) to a second position (FIG. 13). A threaded locking ring 57 (FIG. 6) is rotatably secured between the mounting plate 56 and the locking handle 54 to threadedly receive the threaded fitting 12 of the vacuum bag 14.

Figure 7:
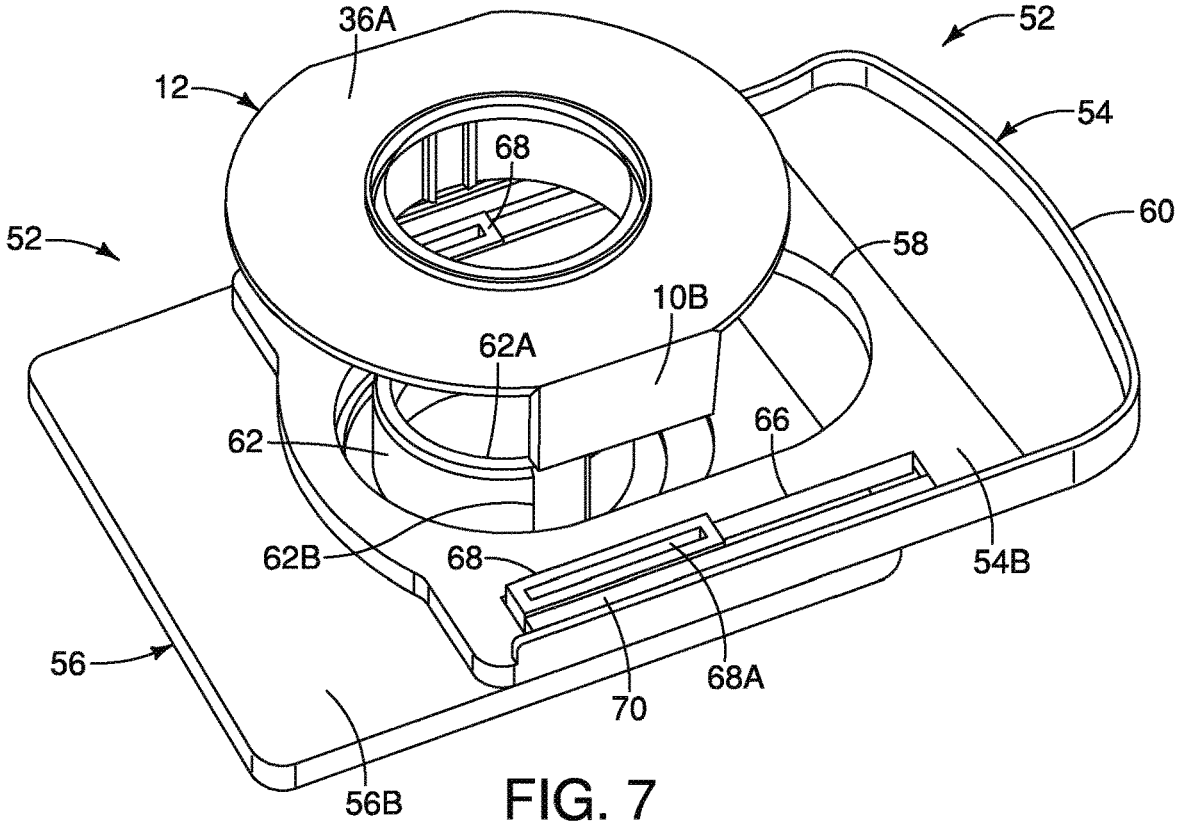
FIG. 7 is a perspective view of the threaded fitting and an attachment assembly of the vacuum cleaner of FIG. 6 prior to the vacuum bag being received by the attachment assembly and a locking handle of the mounting assembly being in a first position.
Figure 8:
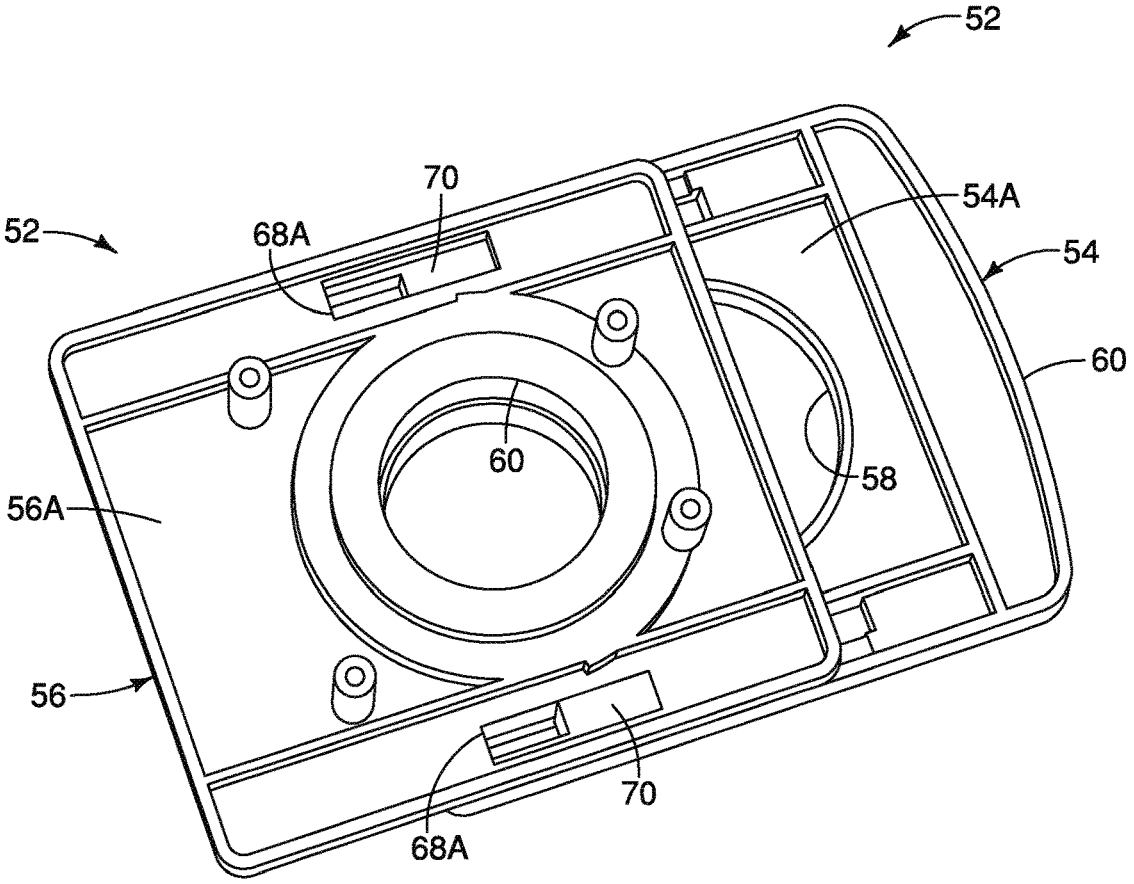
FIG. 8 is a rear perspective view of the mounting assembly of FIG. 7.

The locking handle 54 has an inner surface 54A facing the mounting plate 56 and an outer surface 54B facing the vacuum bag threaded fitting 12, as shown in FIGS. 7 and 8. An opening 58 extends through the locking handle 54 from the inner surface 54A to the outer surface 54B. A handle 60 extends upwardly and away from the opening 58 to facilitate grasping by a user. The locking handle 54 is configured to slidably move relative to the mounting plate 56 from the first, or open, position (FIG. 6) to the second, or closed, position (FIG. 13).

The mounting plate 56 has an inner surface 56A facing away from the locking handle 54 and an outer surface 56B facing the locking handle 54, as shown in FIGS. 7 and 8. A nozzle or projection 62 extends outwardly from the outer surface 56B of the mounting plate 56. An opening 62A in the projection 62 extends completely through the mounting plate 56 from the inner surface 56A to the end of the projection 62.

Figure 10:
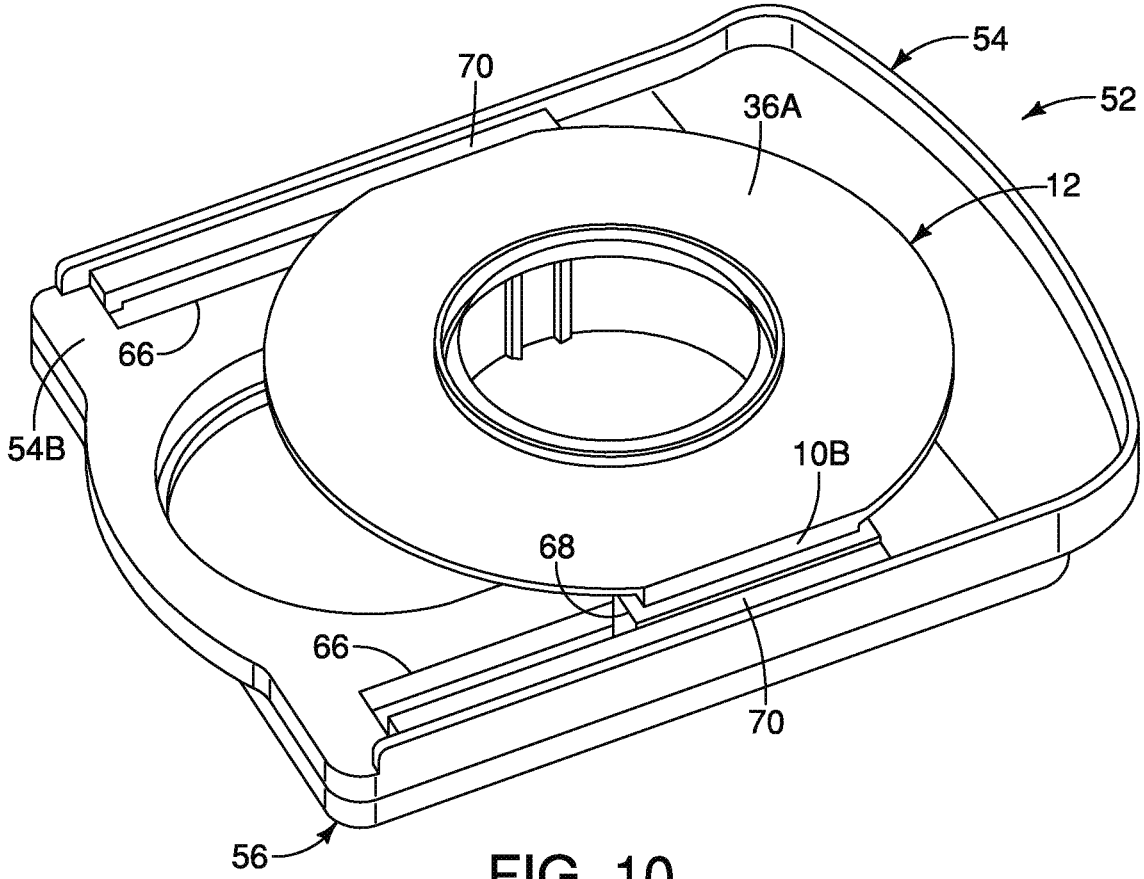
FIG. 10 is a perspective view of the threaded collar received by the attachment assembly of FIG. 7 and the locking handle moved to a second position.

A plurality of slots 66 are disposed in the locking handle 54, as shown in FIGS. 7 and 10. The slots 66 extend in a lengthwise direction of the locking handle 54. In other words, the slots 66 extend in the movement direction of the locking handle 54, and guide movement of the locking handle 54 between an open position (FIG. 6) and a closed position (FIG. 13).

A receiving member 68 of the mounting plate 56 is received by each of the slots 68, as shown in FIGS. 7 and 10. The receiving members 68 extend outwardly from the outer surface 56B of the mounting plate 56. An opening 68A extends through the receiving member 68 and through the mounting plate 56, as shown in FIGS. 7 and 8. A flexible locking member 70 of the locking handle 54 is received in each of the receiving members 68. The flexible locking member 70 engages the opening 68A in the mounting plate 56, thereby preventing movement of the locking handle 54 from the open position shown in FIGS. 8 and 9. The openings 68A in the receiving members 68 extend in a vertical direction when the attachment assembly 52 is connected to the vacuum cleaner.

As shown in FIG. 6, the attachment assembly 52 is connected to the vacuum cleaner body 16. The locking handle 54 is movable between the first, or open, position, as shown in FIG. 6, and the second, or closed, position, as shown in FIG. 13. In the open position shown in FIG. 6, the second part 50 of the housing 46 is prevented from being connected to the first portion 48 by the handle 60 of the locking handle 54. The handle 60 extends beyond outer peripheries of the first and second housing parts 48 and 50, such that the housing 46 is prevented from being closed.

To connect the vacuum bag 14 to the vacuum cleaner body 16 of the vacuum cleaner 15, as shown in FIGS. 6-13, the second housing part 50 is opened with respect to the first housing part 48. The vacuum bag threaded fitting 12 is connected to the attachment assembly 52 by inserting the threaded collar 38 of the threaded fitting 12 such that the guide rails 44 engage guide grooves 62B disposed on an outer surface of the nozzle 62. The guide rails 44 of the threaded collar 38 engage the guide grooves 62B on the outer surface of the mounting plate nozzle 62 to facilitate movement of the threaded fitting 12 as it is threadedly connected to the locking ring 57 (FIG. 6) of the attachment assembly 52.

Figure 9:
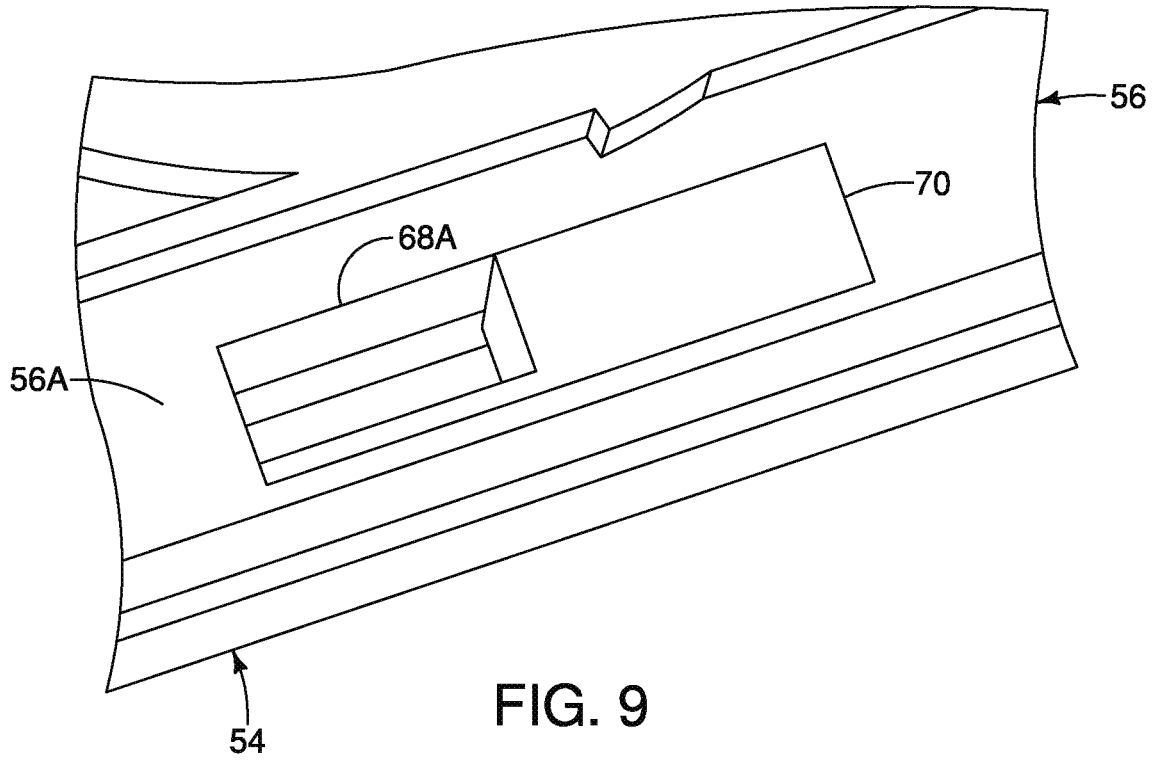
FIG. 9 is an enlarged perspective view of a locking member of the attachment assembly of FIG. 8 in a first position.
Figure 11:
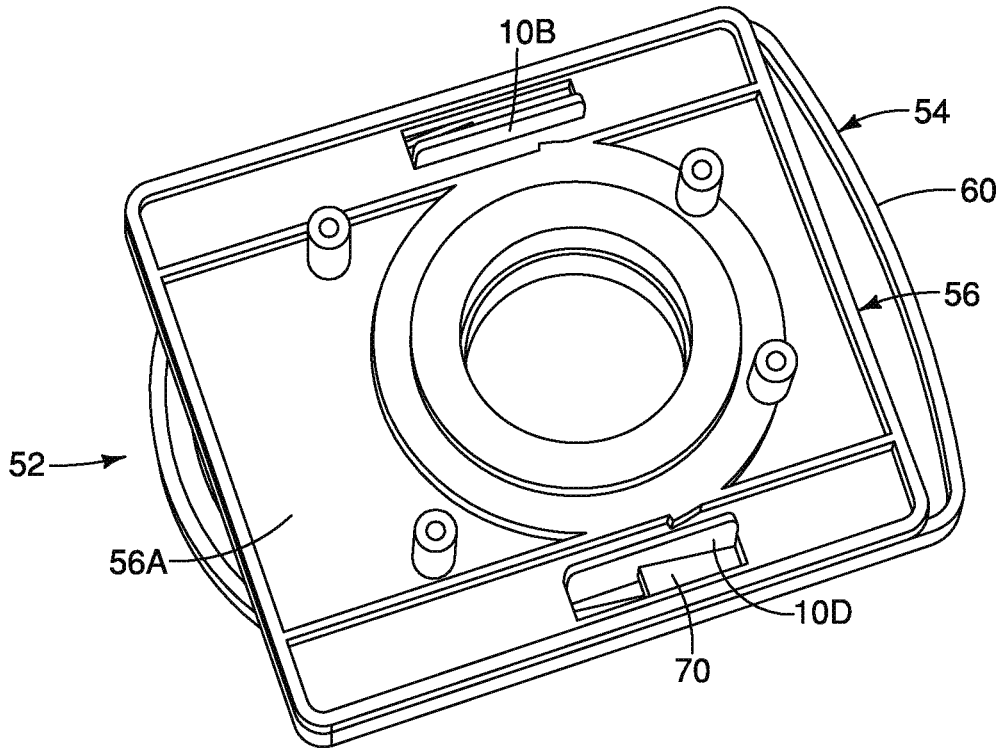
FIG. 11 is a rear perspective view of threaded fitting received by the locking assembly of FIG. 10.
Figure 12:
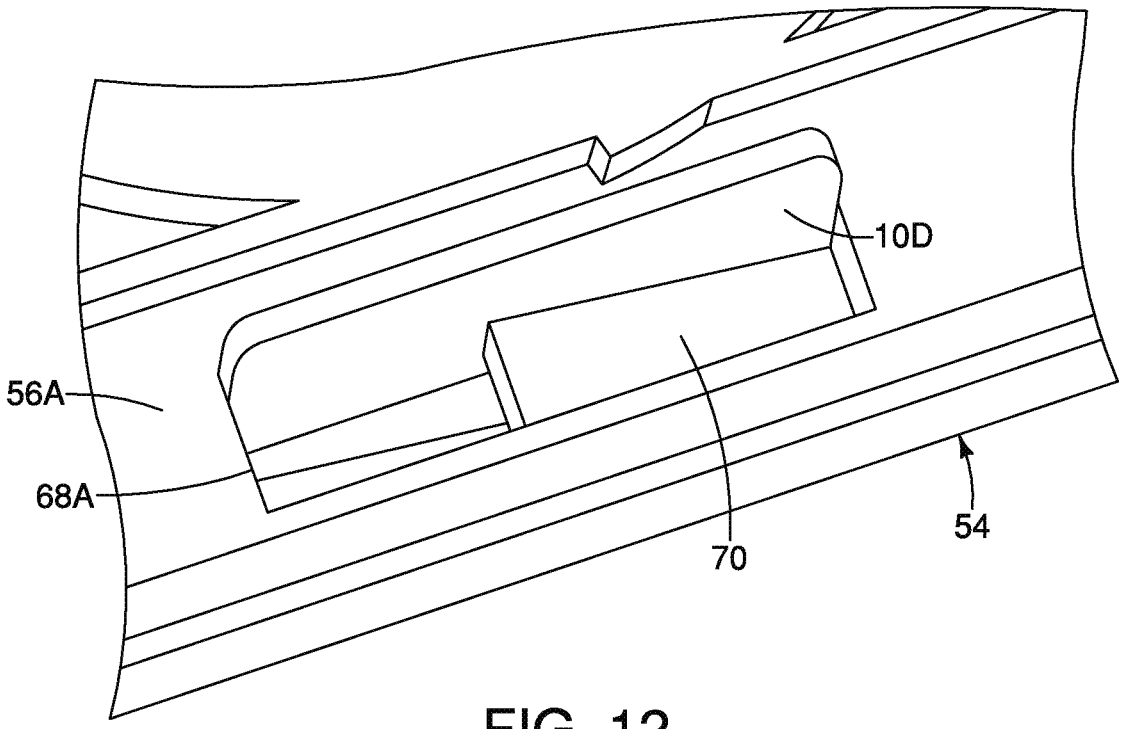
FIG. 12 is an enlarged perspective view of the locking member of FIG. 9 moved to a second position.

When the vacuum bag threaded fitting 12 is initially connected to the attachment assembly 52, as shown in FIG. 10, the locking handle 54 is in the open, or first, position. The locking handle 54 is prevented from moving from the first position to the second position until the mounting tab 44 is received by the attachment assembly 52. The mounting tabs 10A and 10B of the threaded fitting 12 are received by the receiving members 68. Prior to insertion of the mounting tabs 10A and 10B, the locking handle 54 is prevented from moving to the closed, or second, position by the flexible locking member 70 disposed in the opening 68A of the receiving members 68, as shown in FIGS. 8 and 9. When both of the mounting tabs 10A and 10B are fully inserted in the receiving members 68, the mounting tabs 10A and 10B engage the flexible locking members 70, as shown in FIGS. 11 and 12. The engagement of the mounting tabs 10A and 10B with the flexible locking members 70, moves the flexible locking members 70 out of engagement with the openings 68A of the projections, such that the locking handle 54 can move relative to the mounting plate 56. The at least one mounting tabs 10 engages the flexible locking 70 to disengage the flexible locking member 70 from the mounting plate 56 to allow movement of the locking handle 54 from the first position (FIG. 6) to the second position (FIG. 13).

As shown in FIGS. 11 and 12, the locking handle 54 is moved to the closed, or second, position. The handle 60 of the locking handle 54 is now disposed within the housing 46 such that the second part 50 of the housing 45 can now be connected to the first part 48 to close the housing 46. The movement of the locking handle 54 from the open position to the closed position causes the locking ring 57 (FIG. 6) to rotate, which moves the threaded fitting 12 of the vacuum bag 14 in an inward axial direction to secure the vacuum bag 14 to the vacuum cleaner body 16 of the vacuum cleaner 15, as shown in FIG. 13. The guide rails 44 of the vacuum bag threaded fitting 12 are received by the guide grooves 62B of the mounting plate nozzle 62, thereby substantially preventing rotation of the vacuum bag threaded fitting 12, and thus the vacuum bag 14, during connection and disconnection. A substantially air tight seal is created between the vacuum bag threaded fitting 12 and the nozzle of the vacuum cleaner body 16 of the vacuum cleaner 15. The second housing part 50 can then be connected to the first housing part 48 to close the housing 46 so the vacuum cleaner 16 can be operated.

To remove the vacuum bag 14 from the vacuum cleaner body 16 of the vacuum cleaner 15, the above-described process is performed in reverse. The locking handle 54 is lifted upwardly towards the open position, thereby causing rotation of the locking ring away from the vacuum bag threaded fitting 12. When the locking handle 54 returns to the open position, the vacuum bag 14 can be removed from the vacuum cleaner body 16 of the vacuum cleaner. The flexible locking members 70 return to engage the openings 68A in the projections 68 such that the locking handle 54 cannot be returned to the closed position without the subsequent vacuum bag 14 being fully and properly inserted.

The locking handle 54 cannot be moved from the open position of FIG. 6 to the closed position of FIG. 13 until the threaded fitting 12 is fully and properly engaged with the attachment assembly 52. The mounting tabs 10A and 10B are inserted in the openings 68A in the projections 68 of the mounting plate 56 until the outer surface 36B of the flange portion 36 engages both projection 68, as shown in FIG. 10, thereby ensuring proper alignment between the threaded fitting 12 and the attachment assembly 52. By fully inserting the oppositely disposed mounting tabs 10A and 10B, flush mounting of the threaded fitting 12 is ensured, thereby substantially preventing cross-threading of the threaded fitting 12 of the vacuum bag 14 with the attachment assembly 52.

Figure 14:
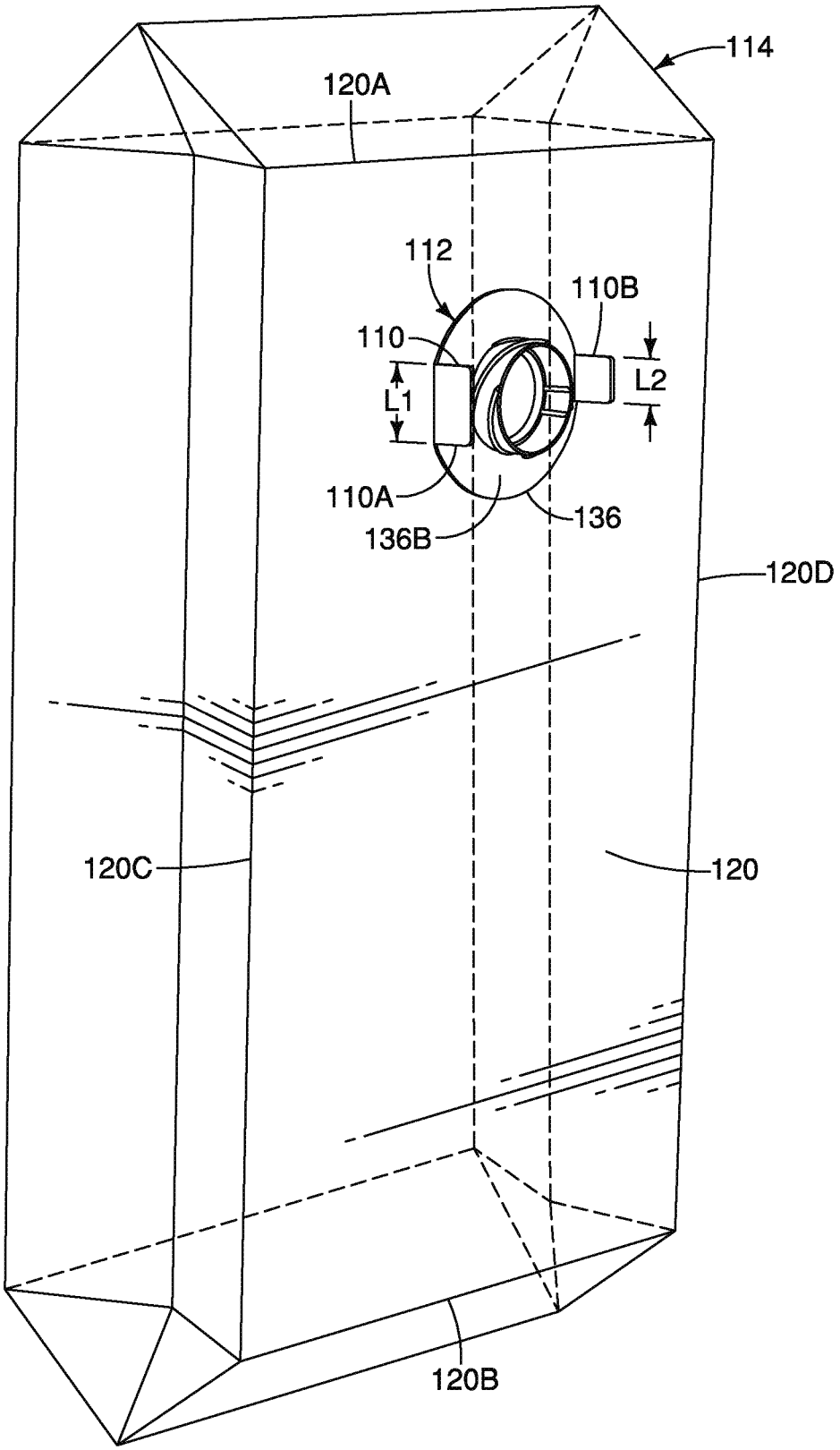
FIG. 14 is a perspective view of a threaded collar of a vacuum bag having two different mounting tabs in accordance with another exemplary embodiment of the present invention.

As shown in FIG. 14, a threaded fitting 112 of a vacuum bag 114 in accordance with another illustrated exemplary embodiment of the present invention is substantially similar to the threaded fitting 12 of the vacuum bag 14 of the exemplary embodiment illustrated in FIGS. 1 to 13 except for the differences described below. Similar parts are identified with similar reference numerals, except increased by 100 (i.e., 1xx, accordingly).

As shown in FIG. 14, the threaded fitting 112 of the vacuum bag 114 have differently configured mounting tabs 110. A first mounting tab 110A and a second mounting tab 110B have different configurations. The first mounting tab 110A has a length L1 that is longer than a length L2 of the second mounting tab 110B. The first and second mounting tabs 110A and 110B extend outwardly from an outer surface 136B of the flange portion 136 of the threaded fitting 112 for substantially the same distance. The length L1 of the first mounting tab 110A on the outer surface 136B of the flange portion 136 is longer than the length L2 of the second mounting tab 110B along the outer surface 136B of the flange portion 136. The first and second mounting tabs 110A and 110B are diametrically opposed such that a line through the centers of the lengths L1 and L2 is substantially parallel to an upper edge 120A and/or a lower edge 120B of the front wall 120 of the vacuum bag 114. Alternatively, the mounting tabs 110A and 110B are offset such that a line through the centers of the lengths L1 and L2 is not substantially parallel to the upper edge 120A and/or the lower edge 120B of the front wall 120 of the vacuum bag 114. The first and second mounting tabs 110A and 110B are preferably substantially parallel. The first and second mounting tabs 110A and 110B are preferably substantially parallel to the first and second side edges 120C and 120D of the front wall 120.

The openings 68A (FIG. 7) of the receiving members 68 of the mounting plate 56 are configured so that one of the openings 68A has a size corresponding to the first mounting tab 110A and the other of the openings 68A has a size corresponding to the second mounting tab 110B. Providing the mounting tabs 110A and 110B with different lengths allows the vacuum bag 114 to be connected to the vacuum cleaner in only one position such that improper installation of the vacuum bag 114 is prevented. The first and second mounting tabs 110A and 110B can have any suitable configurations that are different to prevent improper installation of the vacuum bag 114.

Figure 15:
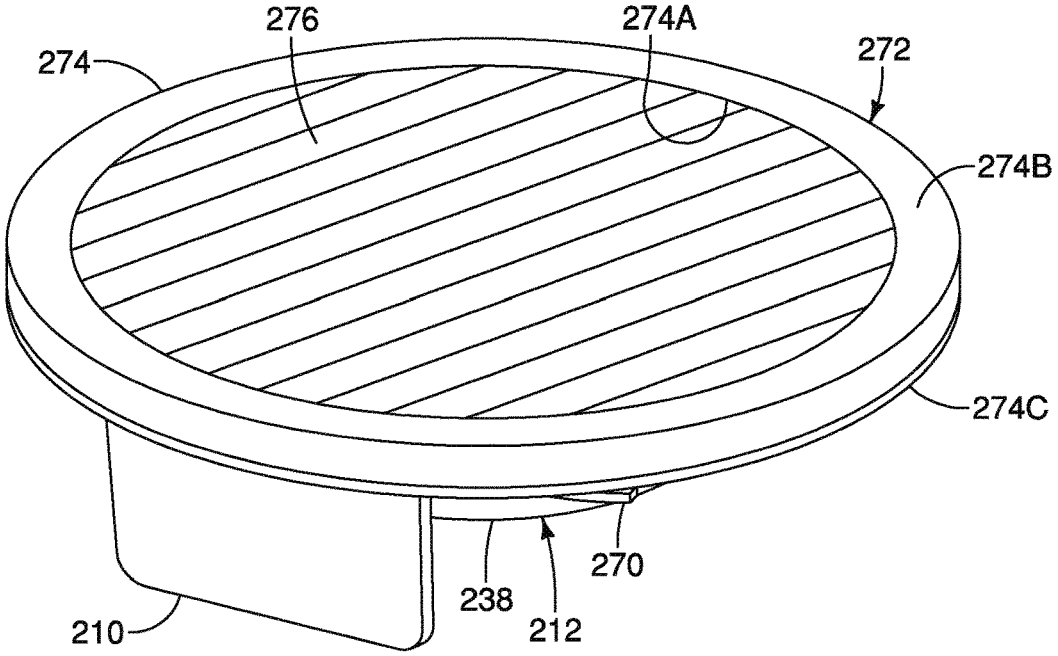
FIG. 15 is a rear perspective view of a threaded collar of a filter assembly.
Figure 16:
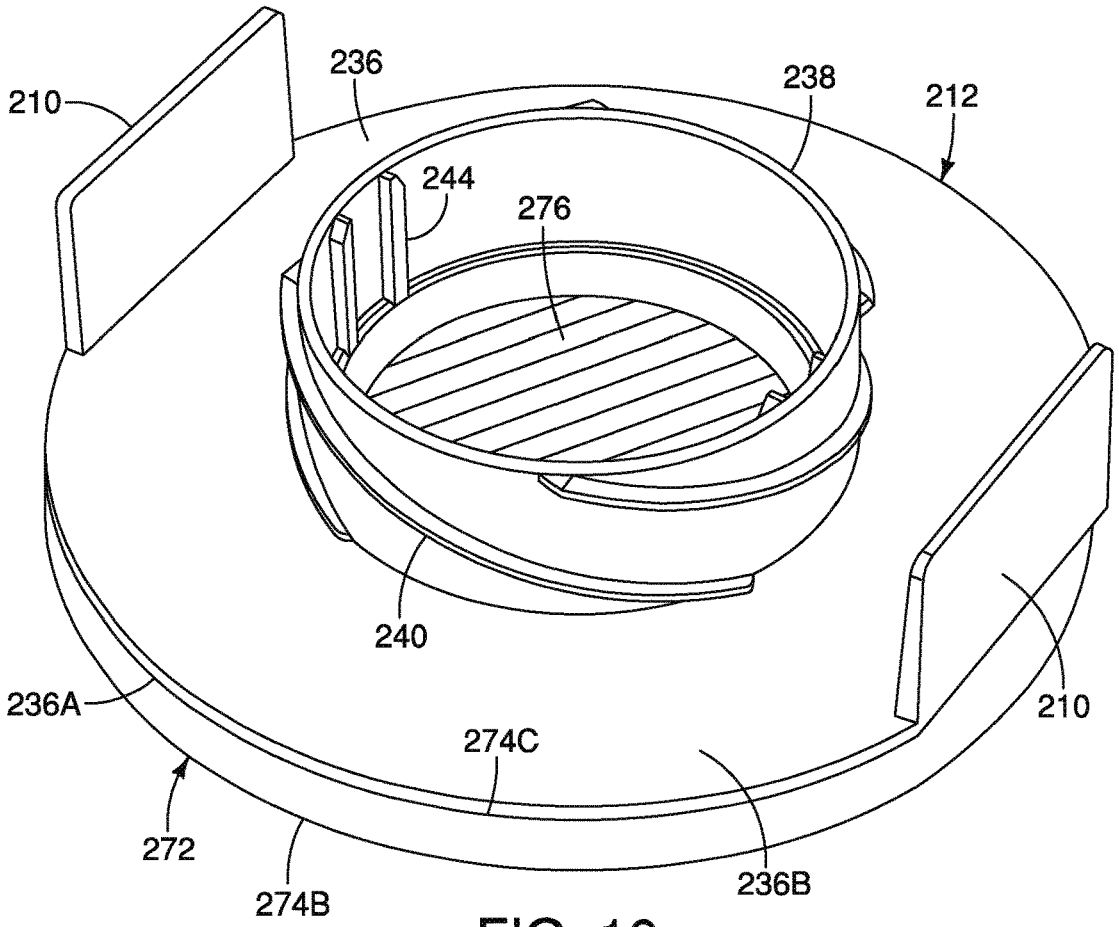
FIG. 16 is a front perspective view of the threaded collar of the filter assembly of FIG. 15.

As shown in FIGS. 15 and 16, a threaded fitting 212 of a filter assembly 274 in accordance with another illustrated exemplary embodiment of the present invention is substantially similar to the threaded fitting 12 of the vacuum bag 14 of the exemplary embodiment illustrated in FIGS. 1 to 13 except for the differences described below. Similar parts are identified with similar reference numerals, except increased by 200 (i.e., 2xx, accordingly).

The dust collecting member of the dust collecting assembly in FIGS. 15 and 16 includes a filter assembly 272. The filter assembly 272 includes a support member 274 that receives a filter 276. The support member 274 defines an opening 274A in which the filter 276 is disposed. A first surface 274B of the support member 274 faces away from the flange 236 of the threaded fitting 212 when the filter assembly 272 is connected thereto. A second surface 274C of the support member 274 faces the flange 236 when the filter assembly is connected to the threaded fitting 212. The second surface 274C of the support member 274 faces the first surface 236A of the flange of the threaded fitting 212. The filter assembly 272 is connected to the flange 236 of the threaded fitting 212 in any suitable manner, such as with an adhesive or by thermowelding.

The threaded fitting 212 is substantially identical to the threaded fitting 12 of FIGS. 1-5. The second surface 236B of the flange 236 of the threaded fitting 212 is configured to face toward the vacuum cleaner 15 (FIG. 6) when the dust collecting assembly is connected to the vacuum cleaner. The threads 240 of the threaded collar 238, the mounting tabs 210 and the guide rails 244 are configured substantially similar to those of the threaded fitting 12 of FIGS. 1-13.

The foregoing detailed description of the certain exemplary embodiments has been provided for the purpose of explaining the principles of the invention and its practical application, thereby enabling others skilled in the art to understand the invention for various exemplary embodiments and with various modifications as are suited to the particular use contemplated. This description is not necessarily intended to be exhaustive or to limit the invention to the exemplary embodiments disclosed. Any of the exemplary embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "upper", "below", "lower", "upward", "upwardly", "downward", "downwardly", "top", "bottom", "side", "vertical", "horizontal", "perpendicular" and "transverse" as well as any other similar directional terms refer to those directions of a vacuum cleaner assembly in an upright position for use. Accordingly, these directional terms, as utilized to describe the vacuum cleaner assembly should be interpreted relative to a vacuum cleaner assembly in an upright position on a horizontal surface. The terms "left" and "right" are used to indicate the "right" when referencing from the right side as viewed from the rear of the vacuum cleaner assembly, and the "left" when referencing from the left side as viewed from the rear of the floor cleaning apparatus.

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

What is claimed is:

1. A dust collecting assembly for a vacuum cleaner, comprising:

a dust collecting member configured to collect dust and debris; and a threaded fitting disposed in communication with the dust collecting member, the threaded fitting including a threaded collar extending in a first direction away from the dust collection member and configured to be connected to a vacuum cleaner; and at least one mounting tab spaced from the threaded collar, the mounting tab extends further than the threaded collar in the first direction away from the dust collection member and being configured to be received by the vacuum cleaner.

2. The dust collecting assembly according to claim 1, wherein the dust collecting member includes a porous container, and an opening disposed in the porous container, the opening being in communication with the threaded fitting, the porous container having a front wall and an oppositely disposed rear wall, the opening being disposed in the front wall.

3. The dust collecting assembly according to claim 1, wherein the dust collecting member includes a filter connected to the threaded fitting.

4. The dust collecting assembly according to claim 1, wherein the at least one mounting tab includes first and second mounting tabs.

5. The dust collecting assembly according to claim 4, wherein the first and second mounting tabs are disposed on opposite sides of the threaded collar.

6. The dust collecting assembly according to claim 1, wherein the threaded fitting is integrally formed as a one-piece member.

7. The dust collecting assembly according to claim 4, wherein the first and second mounting tabs have different lengths.

8. The dust collecting assembly according to claim 1, wherein a length of the threaded collar is longer than a length of the at least one mounting tab in a second direction perpendicular to the first direction.

9. The dust collecting assembly according to claim 2, wherein the threaded collar has an inner surface and an outer surface defining a passage in communication with the opening.

10. The dust collecting assembly according to claim 9, wherein threads are disposed on the outer surface of the threaded collar, and an axially extending guide rail is disposed on the inner surface of the threaded collar.

11. The dust collecting assembly according to claim 1, wherein first and second axially extending guide rails are disposed on opposite sides of the inner surface of the threaded collar, and first and second mounting tabs are disposed on opposite sides of and spaced from the threaded collar, the first and second guide rails being disposed between the first and second mounting tabs.

12. A vacuum cleaner, comprising:

a vacuum cleaner body;

an attachment assembly connected to the vacuum cleaner body, the attachment assembly including a mounting plate connected to the vacuum cleaner body and a locking handle movably connected to the mounting plate, the locking handle being movable from a first position to a second position; and a porous container configured to be connected to the attachment assembly, the porous container including an opening disposed in the porous container; and a threaded fitting disposed in communication with the opening, the threaded fitting including a threaded collar configured to be connected to the attachment assembly; and at least one mounting tab spaced from the threaded collar, the mounting tab being configured to be received by the vacuum cleaner, the locking handle being prevented from moving from the first position to the second position until the at least one mounting tab is received by the attachment assembly.

13. The vacuum cleaner according to claim 12, wherein the locking handle includes a flexible locking member that engages the mounting plate to prevent movement of the locking handle from the first position to the second position.

14. The vacuum cleaner according to claim 13, wherein the at least one mounting tab engages the flexible locking member to disengage the flexible locking member from the mounting plate to allow movement of the locking handle from the first position to the second position.

15. The vacuum cleaner according to claim 12, wherein the at least one mounting tab includes first and second mounting tabs.

16. The vacuum cleaner according to claim 13, wherein the first and second mounting tabs are disposed on opposite sides of the threaded collar.

17. The vacuum cleaner according to claim 14, wherein the first and second mounting tabs have different lengths.

18. The vacuum cleaner according to claim 12, wherein first and second axially extending guide rails are disposed on opposite sides of the inner surface of the threaded collar, and first and second mounting tabs are disposed on opposite sides of and spaced from the threaded collar, the first and second guide rails being disposed between the first and second mounting tabs.

19. The vacuum cleaner according to claim 13, wherein the threaded collar has an inner surface and an outer surface defining a passage in communication with the opening.

20. The vacuum cleaner according to claim 13, wherein threads are disposed on the outer surface of the threaded collar.

21. The vacuum cleaner according to claim 13, wherein a length of the threaded collar is longer than a length of the at least one mounting tab in a direction perpendicular to an axial direction of the opening.

* * * * *